US010895385B2

(12) United States Patent
Otsuki et al.

(10) Patent No.: US 10,895,385 B2
(45) Date of Patent: Jan. 19, 2021

(54) COOKING APPARATUS

(71) Applicant: Panasonic Intellectual Property Management Co., Ltd., Osaka (JP)

(72) Inventors: Yuichi Otsuki, Shiga (JP); Takahide Yamaguchi, Shiga (JP); Takahiro Hayashi, Shiga (JP); Seiichi Yamashita, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 266 days.

(21) Appl. No.: 15/573,030

(22) PCT Filed: Aug. 9, 2016

(86) PCT No.: PCT/JP2016/003661
§ 371 (c)(1),
(2) Date: Nov. 9, 2017

(87) PCT Pub. No.: WO2017/038021
PCT Pub. Date: Mar. 9, 2017

(65) Prior Publication Data

US 2018/0119962 A1 May 3, 2018

(30) Foreign Application Priority Data

Sep. 2, 2015 (JP) ..... 2015-172517

(51) Int. Cl.
*F24C 7/08* (2006.01)
*F24C 7/04* (2006.01)

(52) U.S. Cl.
CPC ..... *F24C 7/088* (2013.01); *F24C 7/04* (2013.01); *F24C 7/043* (2013.01); *F24C 7/085* (2013.01)

(58) Field of Classification Search
CPC .. F24C 7/088; F24C 7/04; F24C 7/085; F24C 7/043
See application file for complete search history.

(56) References Cited

U.S. PATENT DOCUMENTS 5,528,018 A * 6/1996 Burkett ..... F24C 7/087 219/413
5,688,422 A * 11/1997 Landwehr ..... A47J 37/00 219/412

(Continued)

FOREIGN PATENT DOCUMENTS

EP 3104083 A1 12/2016
JP 63-049634 3/1988

(Continued)

OTHER PUBLICATIONS

The Extended European Search Report dated Jul. 26, 2018 for the related European Patent Application No. 16841062.9.

(Continued)

*Primary Examiner* — Vishal Pancholi
*Assistant Examiner* — Bob Zadeh
(74) *Attorney, Agent, or Firm* — Brinks Gilson & Lione

(57) ABSTRACT

Cooking apparatus (10) includes heating chamber (4) in which an object to be heated is rested, radiant heater unit (38) provided inside heating chamber (4) and operating in the preheating mode and cooking mode, and a control unit controlling radiant heater unit (38). The control unit is configured to make radiant heater unit (38) operate in the standby mode, which is a mode after the preheating mode ends and until the cooking mode starts. According to this aspect, the surface temperature of radiant heater unit (38) is kept at a high level during the standby mode to suppress uneven browning due to variations in the surface temperature of radiant heater unit (38) when cooking starts.

2 Claims, 7 Drawing Sheets

(56) References Cited

U.S. PATENT DOCUMENTS

| | | | | |
|---|---|---|---|---|
| 7,009,147 | B1 | 3/2006 | Schulte | |
| 7,875,833 | B2 * | 1/2011 | Song | A23N 12/125 219/389 |
| 2018/0119962 | A1 * | 5/2018 | Otsuki | F24C 7/043 |

FOREIGN PATENT DOCUMENTS

| | | | | |
|---|---|---|---|---|
| JP | 5-032905 | U | | 4/1993 |
| JP | 2003-302052 | | | 10/2003 |
| JP | 2009-250492 | A | | 10/2009 |
| JP | 2011-237142 | | * | 11/2011 |
| JP | 2011-237142 | A | | 11/2011 |
| WO | 2015/118867 | A1 | | 8/2015 |

OTHER PUBLICATIONS

International Search Report of PCT application No. PCT/JP2016/003661 dated Nov. 8, 2016.

* cited by examiner

COOKING APPARATUS

TECHNICAL FIELD

The present disclosure relates to a cooking apparatus that heats foodstuffs inside the heating chamber by means of radiant heat of the heater.

BACKGROUND

This type of cooking apparatus has been using heater control in which the mode is changed from the preheating mode to the cooking mode at the time before preheating ends to stabilize heat distribution inside the heating chamber at the time when starting cooking foodstuffs and thus to suppress uneven browning (refer to PTL 1 for example).

FIG. 8 shows changes of the temperature inside the heating chamber to output power of the heater in an existing cooking apparatus described above. As shown in FIG. 8, the existing heater control changes the heater output from 1,900 W (in the preheating mode) to 1,150 W (in the cooking mode) at the time before preheating ends.

CITATION LIST

Patent Literature

PTL 1: Japanese Utility Model Unexamined Publication No. H05-032905

SUMMARY

In the previous heater control described above, the heater repeats turning on and off before preheating ends and until the cooking mode starts after preheating ends (hereinafter, referred to as "on standby after preheating"). Thus, the surface temperature of the heater is high if the heater is on at the time of cooking start; low, off.

Accordingly, the difference in the surface temperature at the time of cooking start causes uneven browning. Hence, lowering the output of the heater to stabilize heat distribution inside the heating chamber before preheating ends requires a longer time to complete preheating.

An object of the disclosure, to solve the above-described problems, is to suppress uneven browning even if cooking starts immediately after preheating ends without requiring a long time to complete preheating in order to stabilize heat distribution inside the heating chamber.

A cooking apparatus according to one aspect of the present disclosure includes a heating chamber in which an object to be heated is rested, a radiant heater unit provided inside the heating chamber and operating in the preheating and cooking modes, and a control unit controlling the radiant heater unit. The control unit is configured to make the radiant heater unit operate in the standby mode (i.e., a mode after the preheating mode ends and until the cooking mode starts).

According to this aspect, the surface temperature of the radiant heater unit is kept high during the standby mode (i.e., a mode after the preheating mode ends and until the cooking mode starts) to suppress insufficient heating or uneven browning due to variations in the surface temperature of the radiant heater unit when cooking starts.

DETAILED DESCRIPTION OF THE PREFERRED EMBODIMENT

A cooking apparatus according to the first aspect of the present disclosure includes a heating chamber in which an object to be heated is rested, a radiant heater unit provided inside the heating chamber and operating in the preheating and cooking modes, and a control unit controlling the radiant heater unit. The control unit is configured to make the radiant heater unit operate in the standby mode (i.e., a mode after the preheating mode ends and until the cooking mode starts).

According to this aspect, the surface temperature of the radiant heater unit is kept high during the standby mode (i.e., a mode after the preheating mode ends and until the cooking mode starts) to suppress insufficient heating or uneven browning due to variations in the surface temperature of the radiant heater unit when cooking starts.

According to a cooking apparatus of the second aspect of the disclosure, the control unit of the first aspect is configured to set the output voltage of the radiant heater unit in the preheating mode in response to the temperature inside the heating chamber when the preheating mode starts. This aspect suppresses insufficient heating or uneven browning regardless of the chamber-inside temperature when preheating starts.

According to a cooking apparatus of the third aspect of the disclosure, the control unit of the second aspect is configured to control the radiant heater unit so that the output voltage in the preheating mode is kept unchanged in the standby mode and the output voltage is changed when the cooking mode starts. This aspect stabilizes the chamber-inside temperature immediately after preheating ends to suppress insufficient heating or uneven browning.

Hereinafter, a description is made of a cooking apparatus according to an embodiment of the disclosure with reference to the attached drawings.

In this embodiment, cooking apparatus 10 is a business-use microwave oven used in a store such as a convenience store and a fast food store and executes the microwave heating mode, grill mode, and convection mode. Cooking apparatus 10 has a maximum output of 2,000 W and its output is changeable in multiple levels.

Figure 1:
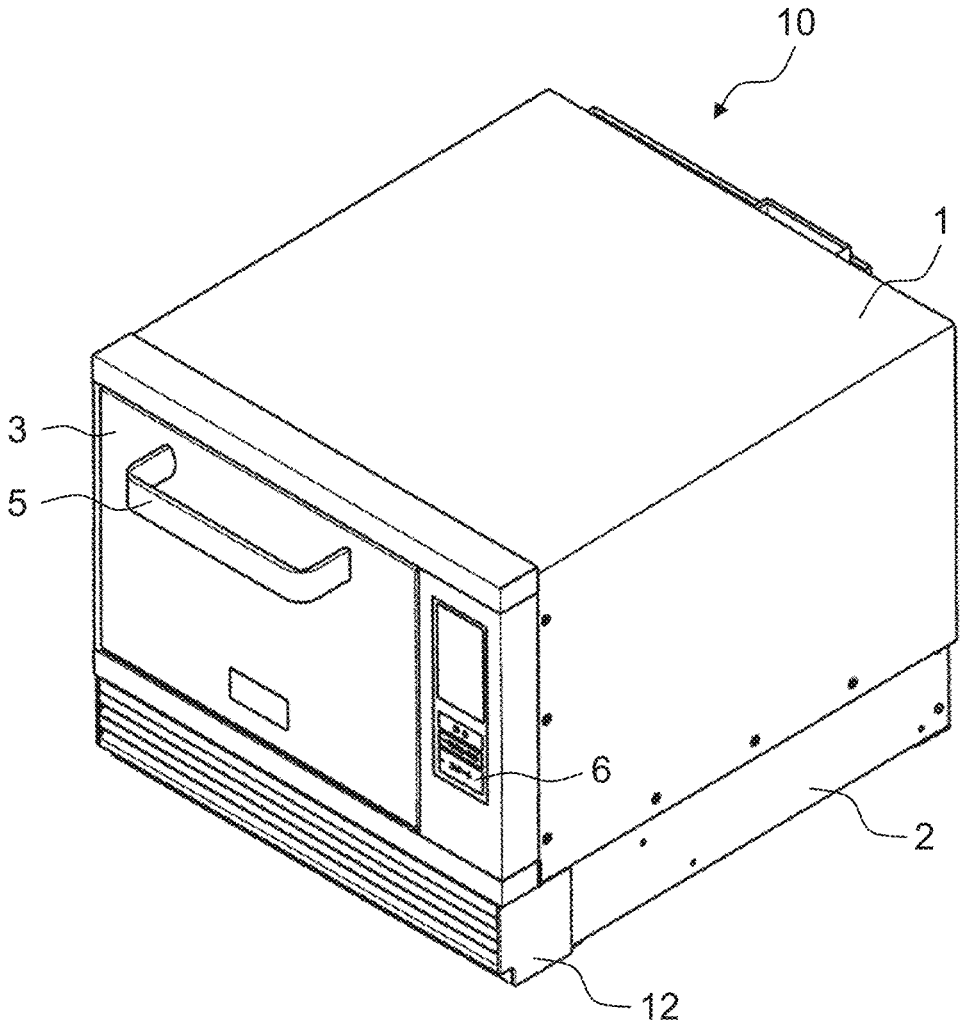
FIG. 1 is an external perspective view of a cooking apparatus according to an exemplary embodiment of the present disclosure.
Figure 2:
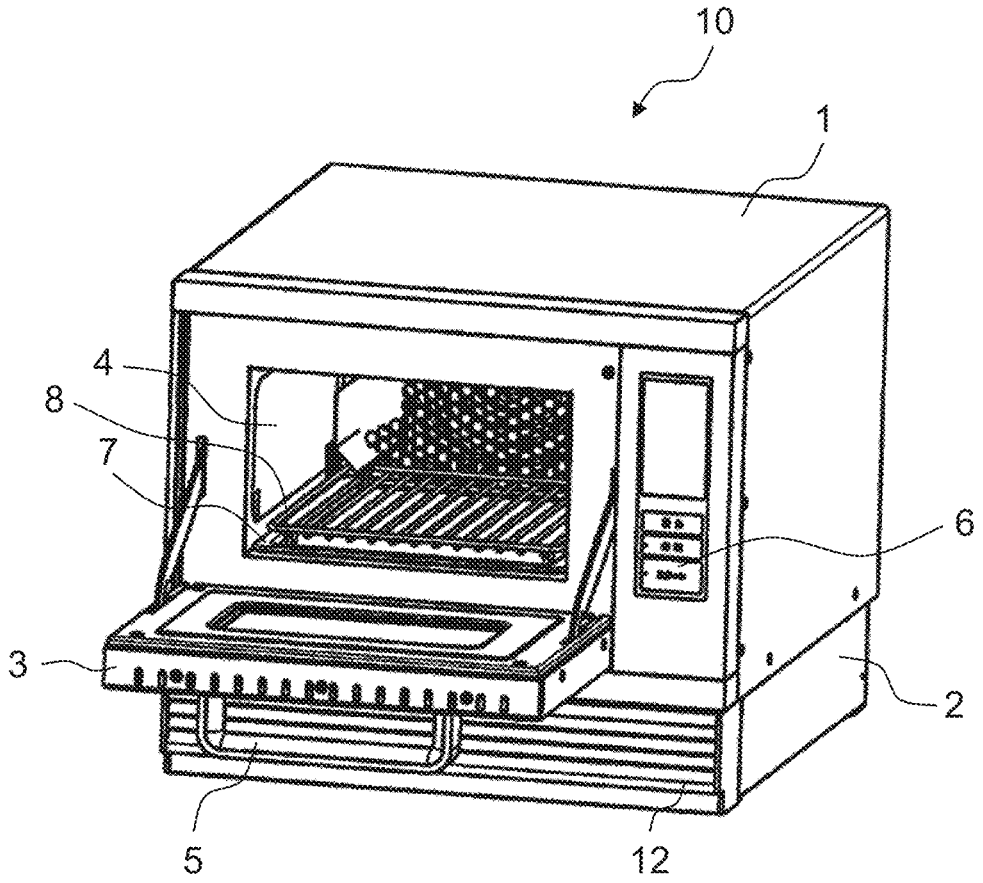
FIG. 2 is a perspective view of the cooking apparatus according to the embodiment, with its door open.
Figure 3:
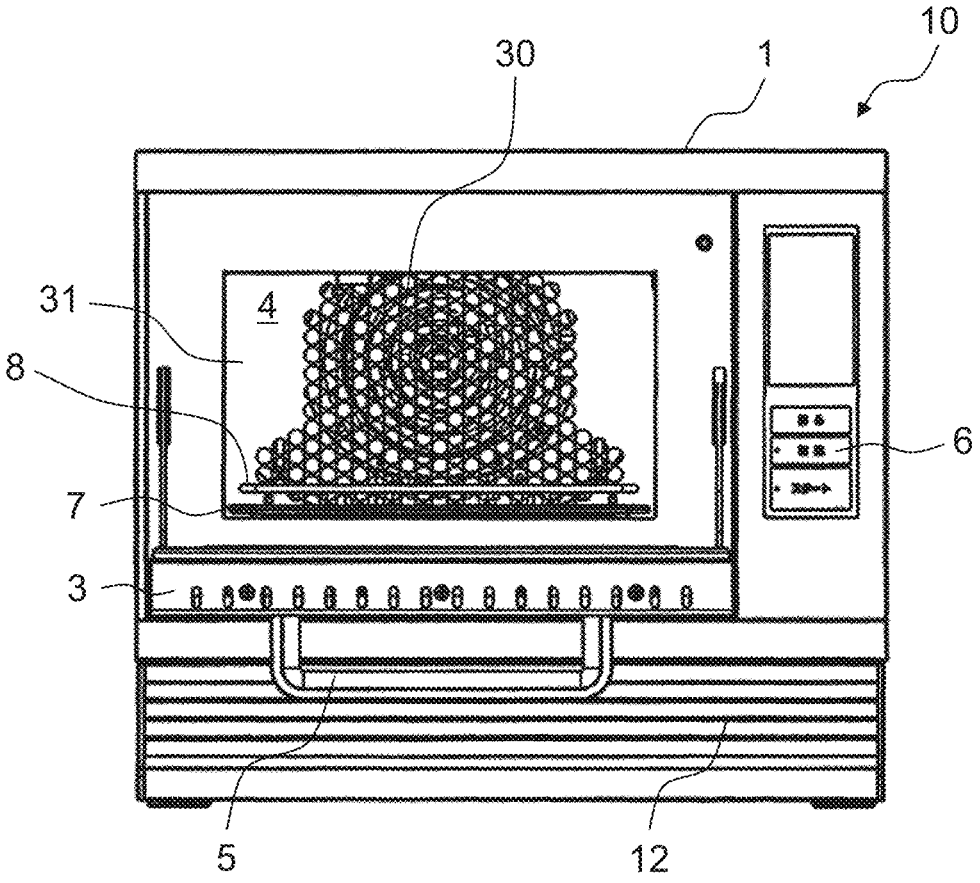
FIG. 3 is a front view of the cooking apparatus according to the embodiment, with its door open.
Figure 4:
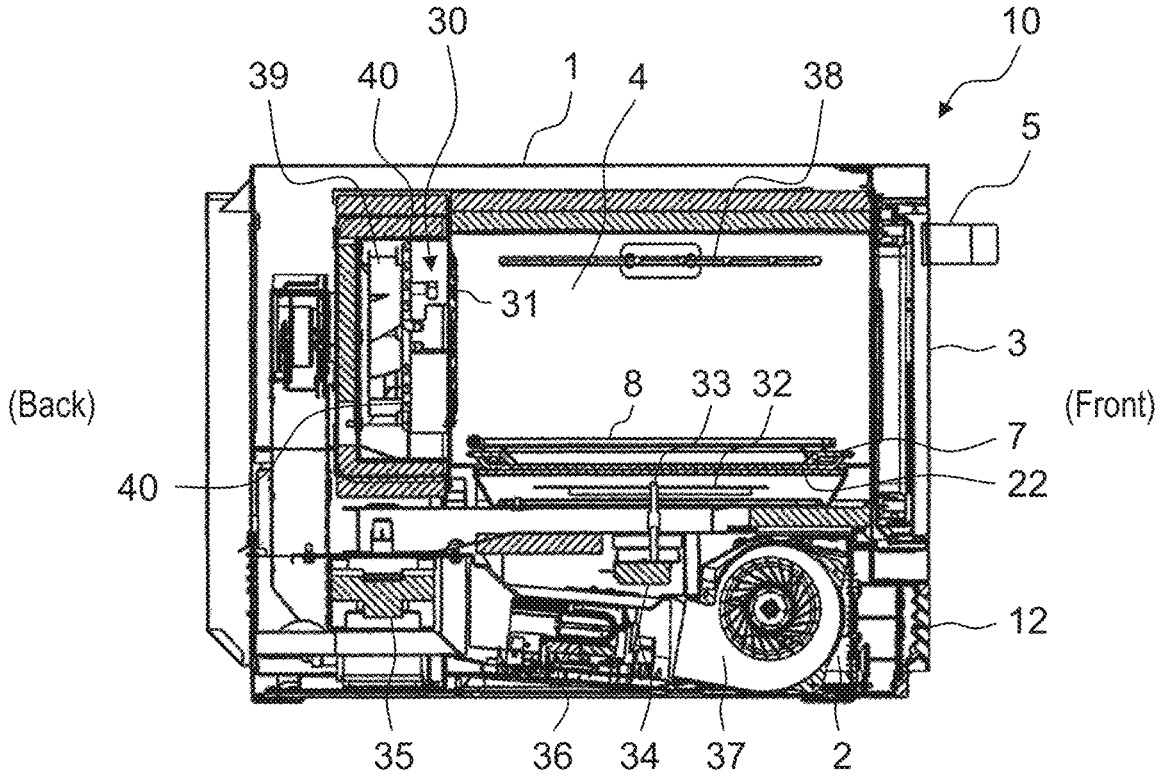
FIG. 4 is a front-back sectional view of the cooking apparatus according to the embodiment.

FIG. 1 is an external perspective view of cooking apparatus 10 according to the exemplary embodiment, with door 3 on its front surface closed. FIGS. 2 and 3 are respectively a perspective view and a front view of cooking apparatus 10, with door 3 open. FIG. 4 is a front-back sectional view of cooking apparatus 10.

As shown in FIGS. 1 and 2, cooking apparatus 10 includes main unit 1, machine compartment 2, and door 3. Machine compartment 2 is provided under main unit 1 so as to support main unit 1. Door 3 is provided on the front surface of main unit 1 so as to close heating chamber 4. Detachable front grill panel 12 is provided on the front surface of machine compartment 2.

As shown in FIG. 2, heating chamber 4 is formed inside main unit 1. Heating chamber 4 has a substantially rectangular parallelepiped space with an opening in its front surface in order to rest an object to be heated inside heating chamber 4.

In this embodiment, the side of heating chamber 4 in which the opening is formed is defined as the front side of cooking apparatus 10; the opposite, as the rear side of cooking apparatus 10. The right side of cooking apparatus 10 viewed from the front is simply defined as the right side; the left side, the left side.

Door 3 is attached with hinges provided under the opening of heating chamber 4. Door 3 is opened and closed vertically using handle 5 provided on door 3. With door 3 closed, heating chamber 4 becomes an enclosed space for heating the object rested in heating chamber 4 with microwaves for example.

In this embodiment, a control panel is installed on the right front side of main unit 1. The control panel is provided with operation unit 6. Operation unit 6 is provided with operation keys and a display unit for setting conditions of heat-cooking. Behind the control panel, a control unit (unillustrated) is provided that receives a signal from operation unit 6 and controls the display unit.

As shown in FIG. 2, tray 7 made of ceramics and wire rack 8 made of stainless steel are disposed inside heating chamber 4 in a containable manner. Concretely, tray 7 is made of cordierite (ceramics with a composition of $2MgO.2Al_2O_3.5SiO_2$).

Wire rack 8 is a rest unit made of a net-shaped material on which an object to be heated is rested. Wire rack 8 allows hot airflow to be efficiently circulated even to the undersurface of the object. Tray 7 is placed under wire rack 8 so as to receive fat for example dropping from the object.

As shown in FIG. 4, machine compartment 2 placed under heating chamber 4 is provided therein with magnetron 35, inverter 36, and cooling fan 37. Magnetron 35 is a microwave generating unit that generates microwaves. Inverter 36 is controlled by the control unit to drive magnetron 35. Cooling fan 37 is controlled by the control unit to cool the inside of machine compartment 2.

Microwaves generated by magnetron 35 travel through the waveguide and are radiated into heating chamber 4 through the microwave emission hole formed in the waveguide and the opening formed in the bottom surface of heating chamber 4. Stirrer 32 is controlled by the control unit to stir microwaves radiated into heating chamber 4. Cooking apparatus 10 thus microwave-heats an object contained in heating chamber 4.

Cooking apparatus 10 includes grill heater 38, which is a radiant heater unit provided near the ceiling of heating chamber 4. In this embodiment, grill heater 38 is a sheath heater. The control unit makes grill heater 38 operate and controls the grill mode. In the grill mode, an object rested in heating chamber 4 is radiant-heated by radiant heat of grill heater 38.

As shown in FIGS. 3 and 4, cooking apparatus 10 includes convection device 30 that is provided behind back surface wall 31 of heating chamber 4 and sends hot airflow into heating chamber 4 to convectively heat an object. Convection device 30 draws air inside heating chamber 4 from the central part of back surface wall 31, heats the air to produce hot airflow, and blows it out from the bottom of back surface wall 31 into heating chamber 4. The hot airflow sent into heating chamber 4 becomes a circulating flow in there.

Inside convection device 30, a thermistor (unillustrated) is provided that is a temperature sensor detecting the temperature of the space inside convection device 30. This thermistor detects a signal corresponding to the temperature of the space inside convection device 30. The control unit makes convection device 30 operate in response to this signal.

Cooking apparatus 10 performs microwave heating, radiant heating, and heating by circulating hot airflow separately, or performs at least two of the three types of heating simultaneously.

In this embodiment, two magnetrons 35 are used (unillustrated), with a total output power of 1,200 W to 1,300 W. Microwaves output from two magnetrons 35 respectively travel through two waveguides, pass through openings formed in the waveguides and in the bottom surface of heating chamber 4, are stirred by stirrer 32, and are radiated into heating chamber 4.

To drive two magnetrons 35, two inverters 36 are provided inside machine compartment 2. Inside machine compartment 2, cooling fans 37 are placed in order to cool magnetron 35 and inverter 36. In this embodiment, for two cooling fans 37 to cool one set of magnetron 35 and inverter 36, a total of four cooling fans 37 are provided.

Cooling fan 37 draws outside air from front grill panel 12 provided on the front surface of machine compartment 2 and sends the air to the rear to cool inverter 36, magnetron 35, and other components. In machine compartment 2, a power circuit board is disposed and a cooling fan for cooling the power circuit board is further provided.

In this embodiment, four cooling fans 37 for inverter 36 and magnetron 35, and a cooling fan for the power circuit board are multiblade fans. A total of five rotation shafts of the cooling fans are disposed linearly.

The air that has travelled to the rear inside machine compartment 2 passes through an exhaust duct disposed on the back surface of main unit 1, moves through between the ceiling of heating chamber 4 and the top surface wall of main unit 1, and is discharged from the front side of main unit 1. This way prevents main unit 1 from becoming too hot.

Hereinafter, a more detailed description is made of the internal structure of cooking apparatus 10 using FIG. 4.

As shown in FIG. 4, tray cradle 22 is made of a plate material made of ceramics that is microwave-transmissive and is placed on the bottom surface of heating chamber 4. Tray 7 is rested on tray cradle 22.

Stirrer 32 is provided between tray cradle 22 and the bottom surface of heating chamber 4. Stirrer 32 is a wafter that rotates around stirrer shaft 33 in order to stir microwaves. Motor 34 is provided inside machine compartment 2 and rotarily drives stirrer 32.

Back surface wall 31 of heating chamber 4 has a large number of openings formed by punching. Behind back surface wall 31, convection device 30 is provided that takes in air inside heating chamber 4, heats the air, and sends out the hot airflow into heating chamber 4. The space where convection device 30 is placed is separated from heating chamber 4 by back surface wall 31 and communicates with heating chamber 4 through the opening formed in back surface wall 31.

As shown in FIG. 4, convection device 30 has hot airflow generation mechanism 39 for generating hot airflow. Hot airflow generation mechanism 39 takes in air inside heating chamber 4, heats the air to generate hot airflow, and sends it out into heating chamber 4. This produces circulating hot airflow inside heating chamber 4.

Figure 5:
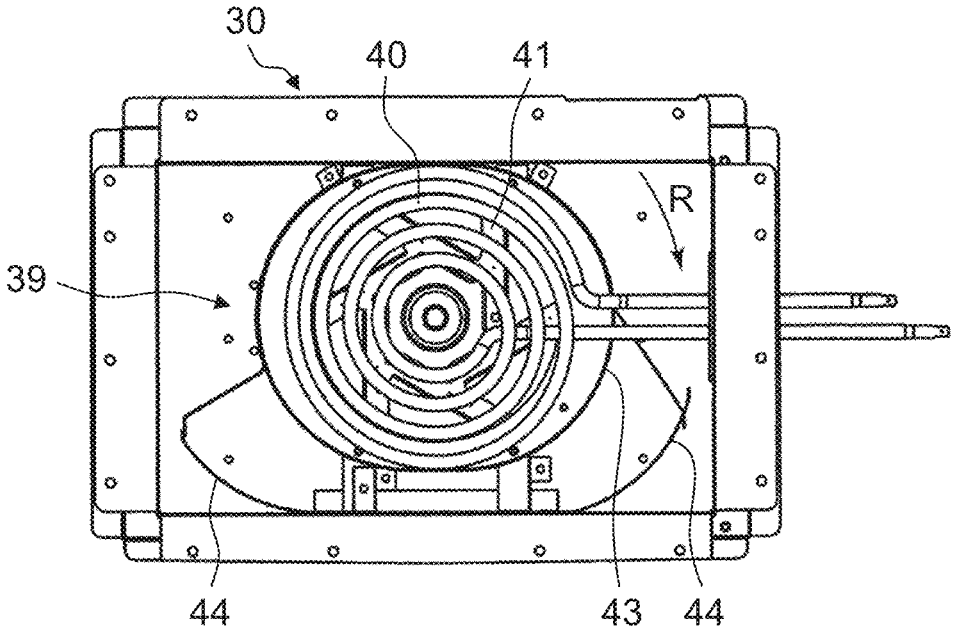
FIG. 5 is a front view of the convection device provided in the cooking apparatus according to the embodiment.

FIG. 5 is a front view of convection device 30. As shown in FIG. 5, hot airflow generation mechanism 39 includes convection heater 40, circulation fan 41, a fan drive unit (unillustrated) that rotarily drives circulation fan 41, and first and second hot airflow guides 43 and 44 that guide hot airflow in hot airflow generation mechanism 39.

Convection heater 40, which is a sheath heater, heats air inside convection device 30. To increase the contact area with air, convection heater 40 is spirally formed at the center (corresponding to the central part of the heating chamber) of convection device 30.

Circulation fan 41 is a centrifugal fan that takes in air at its central part and sends out the air in the centrifugal direction. Circulation fan 41 is disposed behind convection heater 40 and is driven by the fan drive unit provided behind circulation fan 41. In this embodiment, circulation fan 41 rotates in the direction of arrow R (refer to FIG. 5). The control unit controls convection heater 40 and the fan drive unit.

Hereinafter, a description is made of the operation and functions of the cooking apparatus using FIGS. 6A through 6C.

Figure 6A:
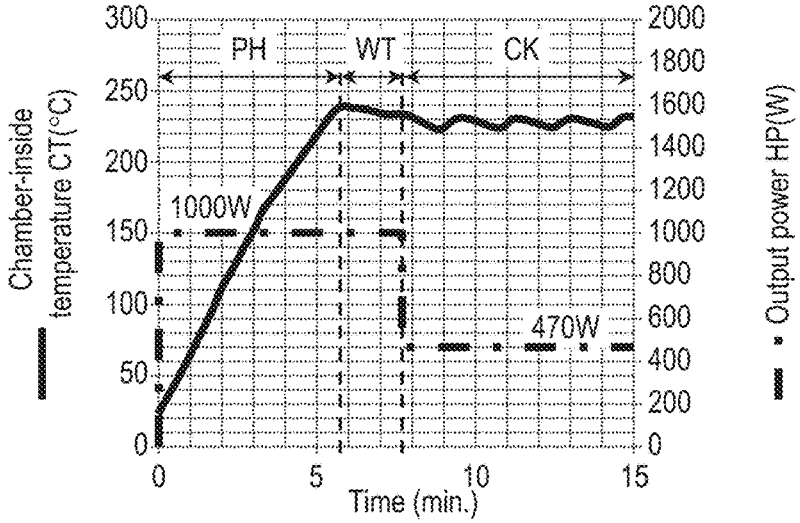
FIG. 6A illustrates changes of the temperature inside the heating chamber to output voltage of the grill heater after preheating starts at room temperature inside the heating chamber.

FIG. 6A illustrates changes of chamber-inside temperature CT of heating chamber 4 to output power HP of grill heater 38 after preheating starts at around 25° C. (referred to as room temperature hereinafter) of chamber-inside temperature CT.

As shown in FIG. 6A, on starting preheating mode PH, grill heater 38 is turned on with output power HP of 1,000 W, and chamber-inside temperature CT of heating chamber 4 rises from room temperature. Although unillustrated, convection device 30 starts its operation simultaneously with turning on of grill heater 38.

After 5 minutes or more have elapsed since preheating started, convection device 30 stops and preheating mode PH ends. Subsequently, grill heater 38 maintains output power HP of preheating. The time period after preheating mode PH ends and until cooking mode CK starts is referred to as standby mode WT. In FIG. 6A, after approximately 2 minutes of standby mode WT, output power HP of grill heater 38 drops to 470 W and cooking mode CK starts.

Figure 6B:
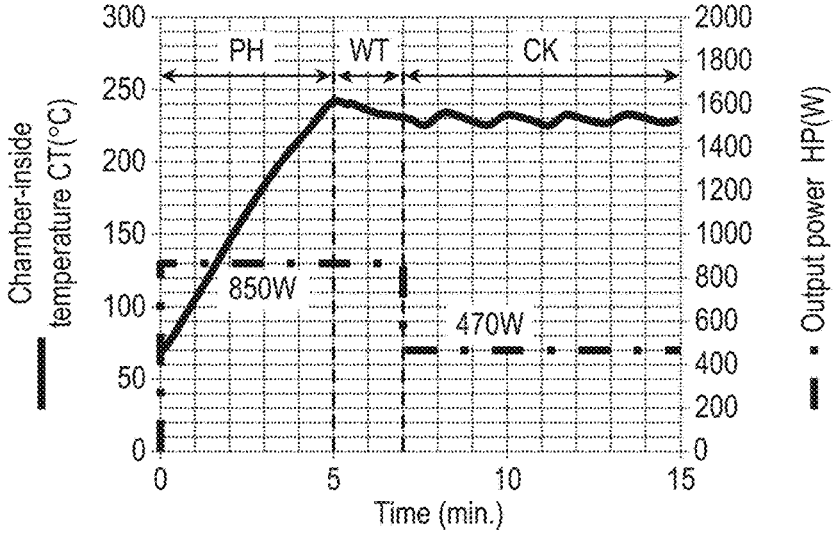
FIG. 6B illustrates changes of the temperature inside the heating chamber to output voltage of the grill heater after preheating starts at middle temperature inside the heating chamber.

FIG. 6B illustrates changes of chamber-inside temperature CT of heating chamber 4 to output power HP of grill heater 38 after preheating starts at around 70° C. (referred to as middle temperature hereinafter) of chamber-inside temperature CT.

As shown in FIG. 6B, on starting preheating mode PH, grill heater 38 is turned on with output power HP of 850 W, and chamber-inside temperature CT of heating chamber 4 rises from middle temperature. In other words, at chamber-inside temperature CT of middle temperature, grill heater 38 is activated with output power HP lower than that of room temperature. Although unillustrated, convection device 30 starts its operation simultaneously with turning on of grill heater 38.

After 5 minutes have elapsed since preheating started, convection device 30 stops and preheating mode PH ends. Subsequently, grill heater 38 maintains output power HP of preheating. In FIG. 6B, after approximately 2 minutes of standby mode WT, output power HP of grill heater 38 drops to 470 W and cooking mode CK starts.

Figure 6C:
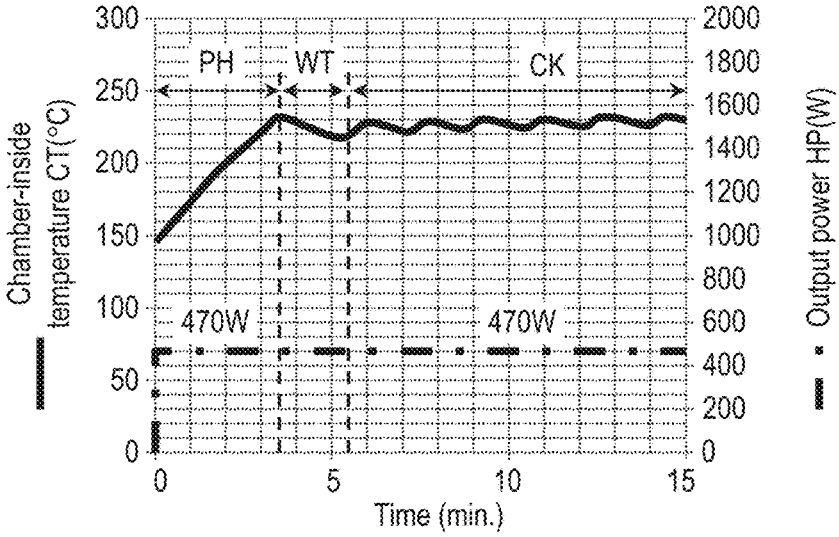
FIG. 6C illustrates changes of the temperature inside the heating chamber to output voltage of the grill heater after preheating starts at high temperature inside the heating chamber.

FIG. 6C illustrates changes of chamber-inside temperature CT of heating chamber 4 to output power HP of grill heater 38 after preheating starts at around 150° C. (referred to as high temperature hereinafter) of chamber-inside temperature CT.

As shown in FIG. 6C, on starting preheating mode PH, grill heater 38 is turned on with output power HP of 470 W, and chamber-inside temperature CT of heating chamber 4 further rises from high temperature. In other words, at chamber-inside temperature CT of high temperature, grill heater 38 is activated with output power HP lower than that of middle temperature. Although unillustrated, convection device 30 starts its operation simultaneously with turning on of grill heater 38.

After 3 minutes and a half have elapsed since preheating started, convection device 30 stops and preheating mode PH ends. Subsequently, grill heater 38 maintains output power HP of preheating. Even in this case, after approximately 2 minutes of standby mode WT, cooking mode CK starts; however, output power HP of grill heater 38 maintains 470 W.

In this embodiment after all, during standby (i.e., a period after preheating ends and until cooking starts), grill heater 38 is not turned off and operates with output power HP during preheating.

This embodiment continues supplying power to grill heater 38 even after preheating ends to keep the surface temperature of grill heater 38 at a high level. This suppresses insufficient heating or uneven browning.

Chamber-inside temperature CT immediately after preheating ends is less stable when chamber-inside temperature CT is relatively low at starting of preheating than that is relatively high. Accordingly, starting cooking immediately after preheating ends may cause insufficient heating or uneven browning.

According to this embodiment, if chamber-inside temperature CT at starting of preheating is relatively low, the output power of grill heater 38 is set relatively high to suppress insufficient heating or uneven browning.

Figure 7:
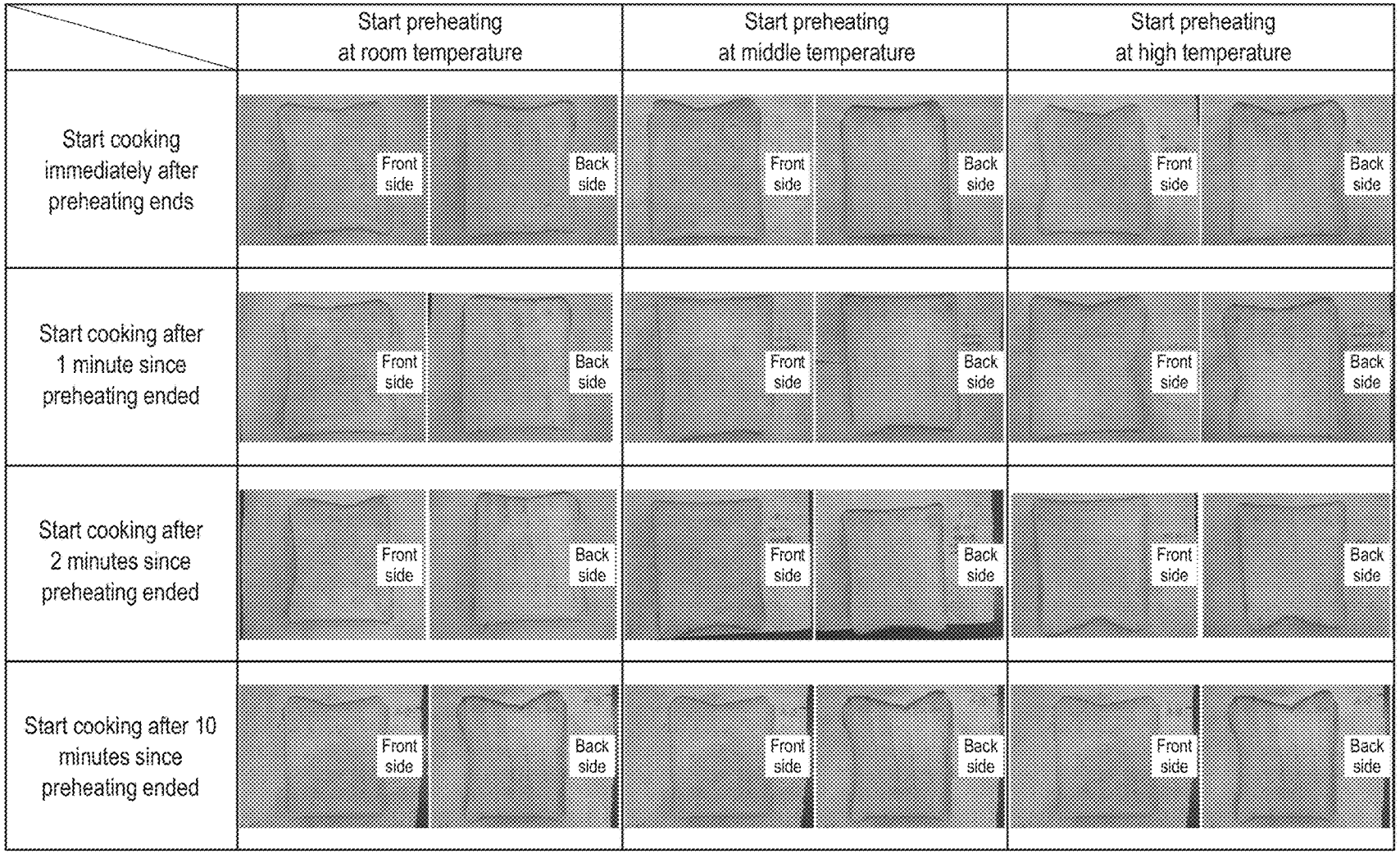
FIG. 7 shows results of cooking according to the embodiment.
Figure 8:
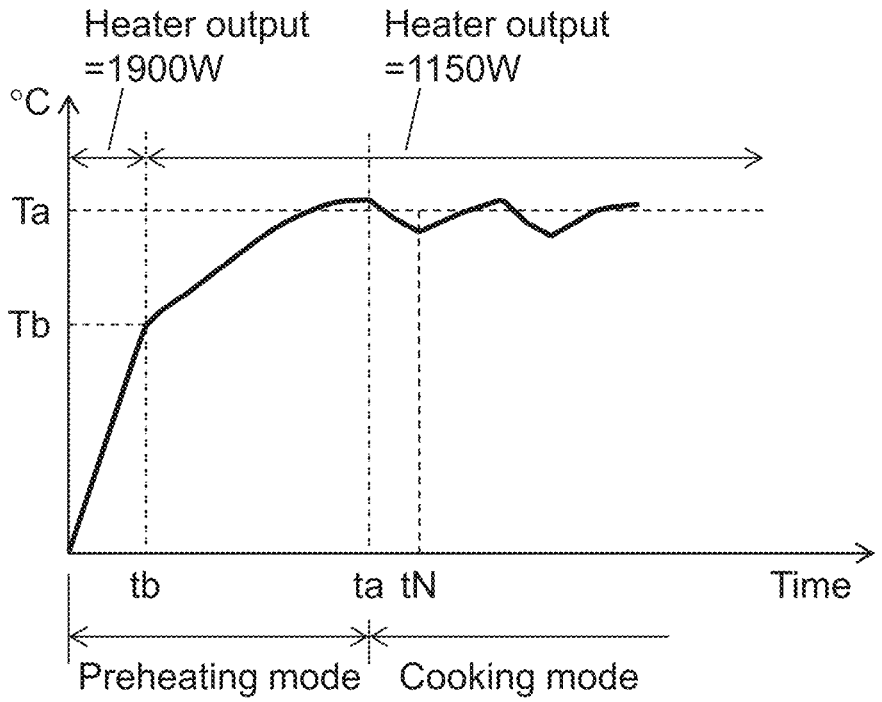
FIG. 8 illustrates changes of the temperature inside the heating chamber to output voltage of the grill heater in an existing cooking apparatus.

FIG. 7 includes photos showing results of toasting bread according to the embodiment. The results show favorable finish without insufficient heating or uneven browning in any of the cases: start preheating at room temperature, start preheating at middle temperature, and start preheating at high temperature.

INDUSTRIAL APPLICABILITY

The present disclosure is applicable to a microwave oven with conventional oven function for example.

REFERENCE MARKS IN THE DRAWINGS

1 main unit
2 machine compartment
3 door
4 heating chamber
5 handle
6 operation unit
7 tray
8 wire rack

10 cooking apparatus
12 front grill panel
22 tray cradle
30 convection device
31 back surface wall
32 stirrer
33 stirrer shaft
34 motor
35 magnetron
36 inverter
37 cooling fan
38 grill heater
39 hot airflow generation mechanism
40 convection heater
41 circulation fan
43 hot airflow guide

The invention claimed is:

1. A cooking apparatus comprising:

a heating chamber in which an object is rested;

a radiant heater unit including a convection heater and a circulation fan that are provided inside the heating chamber, and configured to radiant-heat the object rested in the heating chamber by radiant heat;

a convection device provided behind a back surface wall of the heating chamber, and configured to take in air inside the heating chamber, heat the air, and send out a hot airflow into the heating chamber;

a fan drive unit configured to drive the circulation fan; and a control unit having a preheating mode and a cooking mode as heating modes, and configured to control the radiant heater unit and the convection device, wherein:

the control unit is configured to start operating the radiant heater unit and the convection device simultaneously when the preheating mode starts, the control unit is configured to set a first output power of the radiant heater unit from among a plurality of output power values, a value of the first output power being different in response to a different starting temperature inside the heating chamber when the preheating mode starts, the control unit is configured to stop the convection device after a predetermined time since the preheating mode started, and the control unit is configured to continue to make the radiant heater unit operate without turning off the radiant heater unit during a period after the preheating mode ends and until cooking starts.

2. The cooking apparatus according to claim 1, wherein:

the control unit is configured to change the first output power to a second output power when the cooking mode starts.

* * * * *